US011410623B2

(12) United States Patent
Fang et al.

(10) Patent No.: US 11,410,623 B2
(45) Date of Patent: Aug. 9, 2022

(54) CONTROL METHOD OF TIME SEQUENTIAL CONTROL SIGNAL AND DRIVING CIRCUIT

(71) Applicant: TCL CHINA STAR OPTOELECTRONICS TECHNOLOGY CO., LTD., Guangdong (CN)

(72) Inventors: Xiaoli Fang, Guangdong (CN); Guangxing Xiao, Guangdong (CN)

(73) Assignee: TCL CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 212 days.

(21) Appl. No.: 16/765,762

(22) PCT Filed: May 12, 2020

(86) PCT No.: PCT/CN2020/089768

§ 371 (c)(1),
(2) Date: May 20, 2020

(87) PCT Pub. No.: WO2021/203516

PCT Pub. Date: Oct. 14, 2021

(65) Prior Publication Data

US 2022/0114978 A1 Apr. 14, 2022

(30) Foreign Application Priority Data

Apr. 7, 2020 (CN) ..... 202010264923.3

(51) Int. Cl.
*G09G 3/36* (2006.01)

(52) U.S. Cl.
CPC ..... *G09G 3/3611* (2013.01); *G09G 2310/08* (2013.01); *G09G 2340/0435* (2013.01)

(58) Field of Classification Search
CPC .. H01M 10/42; H01M 10/48; G01R 31/2829; G01R 15/202; G01R 31/364;
(Continued)

(56) References Cited

U.S. PATENT DOCUMENTS

2003/0189543 A1* 10/2003 Nakayoshi ..... G09G 3/3655 345/98
2007/0262944 A1* 11/2007 Chen ..... G09G 3/3685 345/98
(Continued)

FOREIGN PATENT DOCUMENTS

CN 202601137 U 12/2012
CN 102930845 A 2/2013
(Continued)

*Primary Examiner* — Shaheda A Abdin

(57) ABSTRACT

A control method of a time sequential control signal and a driving circuit are provided. A main TCON chip and an assist TCON chip compute corresponding frame rates according to pixel clock signal frequencies, then call a corresponding table, and transmit the table to a first driving unit and a second driving unit respectively. The first driving unit and the second driving unit respectively perform scanning on rows and columns of pixels to allow complicated dynamic images to be displayed with smooth motions.

17 Claims, 4 Drawing Sheets

(58) Field of Classification Search
CPC ..... G01R 31/36; G01R 1/18; G01R 19/0092; G01R 15/20; G01R 15/14; G01R 1/203; Y02E 60/10; H02J 7/0048; H02J 7/005
See application file for complete search history.

(56) References Cited

U.S. PATENT DOCUMENTS

| | | | | |
|---|---|---|---|---|
| 2008/0239147 | A1* | 10/2008 | Kung | H04N 21/4305 348/E5.011 |
| 2014/0132493 | A1 | 5/2014 | Wu et al. | |
| 2014/0223219 | A1* | 8/2014 | Aelion | G06F 1/324 713/400 |
| 2016/0125845 | A1 | 5/2016 | Oh et al. | |
| 2016/0321984 | A1 | 11/2016 | Kim et al. | |
| 2019/0005862 | A1* | 1/2019 | Zhang | G09G 3/20 |

FOREIGN PATENT DOCUMENTS

| | | | |
|---|---|---|---|
| CN | 106097950 | A | 11/2016 |
| CN | 106205460 | A | 12/2016 |
| CN | 110415661 | A | 11/2019 |
| CN | 110827777 | A | 2/2020 |
| KR | 20160079562 | A | 7/2016 |
| TW | I413053 | B | 10/2013 |

* cited by examiner

CONTROL METHOD OF TIME SEQUENTIAL CONTROL SIGNAL AND DRIVING CIRCUIT

FIELD OF INVENTION

The present disclosure relates to the field of liquid crystal display technology, and particularly relates to a control method of a time sequential control signal and a driving circuit.

BACKGROUND OF INVENTION

Traditional liquid crystal display equipment, such as cathode ray tube display equipment, liquid crystal display equipment, light emitting diode display equipment, organic light emitting diode display equipment, active matrix organic light emitting diode equipment, etc., are operated under a constant refresh rate such as 60 Hz, 85 Hz, or 120 Hz. In other words, configuration of the liquid crystal display equipment is refreshing each pixel of a screen under a certain frequency, and video signals transmitted to the display equipment need to match a constant frequency of the refresh rate of the display equipment. When the display equipment is operated at 60 Hz, the pixels of the display is refreshed by 16.6 ms, and each frame occupies different time for being rendered by driving chips.

Furthermore, a frame may need a time of 12 ms to be rendered, and another frame with more complicated geometric structures may need a time of 30 ms to be rendered. When a next frame is outputted to the display equipment through a video port, a completely rendered frame may not be ready in a buffer frame area. This situation will cause image artifacts, so audience will be aware of an incoherent video. For example, if the outputted images to the display equipment are partially replaced through frames, then image tear effect may occur. However, only when an input source is changed can the refresh rate be changed. This will encounter a problem during complicated geometric structures. The images are constantly changing, while performances of graphics processing units (GPUs) and central processing units (CPUs) of traditional display equipment are constant, which leads to frame rates of the images being sometimes high and sometimes low, and cannot synchronize with a refresh rate of the display equipment screens. In severe cases, it will cause a game screen to tear, destroying picture quality experience.

A clock signal frequency of videos aiming at complicated geometric structures is often greater than 60 Hz, and two timing controller (TCON) chips are used to simultaneously detect the clock signal frequencies. Because each TCON chip has its own frequency detection mechanism, when a certain frequency is detected, a corresponding table is called, and difference exists between phases of system clocks of each TCON chip, thereby causing each TCON chip to have different frequency detection results. Moreover, TCON chips on two sides call different tables, so that corresponding driving units generate scanning signals with different voltages, resulting in uneven image brightness and colors of the liquid crystal equipment screens. Secondly, constant frequencies are used in the liquid crystal equipment screens, so complicated dynamic images cannot be displayed with smooth motions, resulting in deterioration of picture quality. For example, a frame rate of one TCON module is at 48 Hz to 60 Hz, then, table 1 is called, and another frame rate of one TCON module is at 60 Hz to 120 Hz, then, table 2 is called. Values in table 1 and table 2 are usually different flipping voltage values of driving pixels or grayscale values of the pixels. Performances of images are different by calling different tables. For example, the table 1 is called for a display region on a left side, the table 2 is called for a display region on a right side, and parameters in the table 1 are greater than those of the table 2, resulting in color and brightness of the display region on the left side being greater than color and brightness of the display region on the right side.

Therefore, the technical problem needs to be solved, that is, using two TCON chips liquid crystal display devices in the prior art causes unevenness of image brightness and colors of liquid crystal display panels incurred by change of detected frequencies being different and called tables being different, thereby leading to different flipping voltage values of driving pixels or grayscale values of the pixels being generated.

SUMMARY OF INVENTION

Embodiments of the present disclosure provide a control method of a time sequential control signal and a driving circuit, which can solve the technical problem that using two TCON chips liquid crystal display devices in the prior art causes unevenness of image brightness and colors of liquid crystal display panels incurred by change of detected frequencies being different and called tables being different, thereby leading to different flipping voltage values of driving pixels or grayscale values of the pixels being generated.

In order to solve the problems mentioned above, technical solutions provided by the present disclosure are as follows:

an embodiment of the present disclosure provides a control method of a time sequential control signal, and the method includes:

step 1: detecting a first current pixel clock signal frequency corresponding to a liquid crystal display panel on a control circuit board by a main timing controller (TCON) chip on the control circuit board, and computing a frame rate of a first current frame according to the first current pixel clock signal frequency;

step 2: if the frame rate of the first current frame and a frame rate of a first previous frame have changed, the main TCON chip calls a table corresponding to the frame rate of the first current frame, and an assist TCON chip on the control circuit board also obtains the table;

step 3: the main TCON chip and the assist TCON chip respectively transmitting the table to a plurality of driving units on two sides of the liquid crystal display panel, the plurality of driving units outputting a plurality of scanning signals corresponding to the table according to the table, and the plurality of scanning signals performing scanning on rows or columns of pixels of the liquid crystal display panel.

According to a preferably embodiment of the present disclosure, the step 1 of detecting the first current pixel clock signal frequency corresponding to the liquid crystal display panel on the control circuit board by the main TCON chip on the control circuit board, and computing the frame rate of the first current frame according to the first current pixel clock signal frequency specifically includes:

after the liquid crystal display panel being powered on, the main TCON chip and the assist TCON chip obtaining an initial table in a storage medium on the control circuit board;

the main TCON chip and the assist TCON chip simultaneously detecting pixel clock signal frequencies in a video input signal on the control circuit board to obtain the first current pixel clock signal frequency and a second current pixel clock signal frequency;

the frame rate of the first current frame computed by the main TCON chip being the first current pixel clock signal frequency divided by a total number of the pixels of the liquid crystal display panel; and a frame rate of a second current frame computed by the assist TCON chip being the second current pixel clock signal frequency divided by the total number of the pixels of the liquid crystal display panel.

According to a preferably embodiment of the present disclosure, the step 2 of if the frame rate of the first current frame and the frame rate of the first previous frame have changed, the main TCON chip calls the table corresponding to the frame rate of the first current frame, and the assist TCON chip on the control circuit board also obtains the table specifically further includes:

the frame rate of the first current frame computed by the main TCON chip and the frame rate of the first previous frame computed by the main TCON chip being different, and the frame rate of the second current frame computed by the assist TCON chip and a frame rate of a second previous frame computed by the assist TCON chip being different;

a difference between the frame rate of the first current frame and the frame rate of the second current frame being less than a preset threshold value, and the main TCON chip and the assist TCON chip respectively calling a same table according to the frame rate of the first current frame and the frame rate of the second current frame.

According to a preferably embodiment of the present disclosure, the preset threshold value is 5.

According to a preferably embodiment of the present disclosure, the step 1 of detecting the first current pixel clock signal frequency corresponding to the liquid crystal display panel on the control circuit board by the main TCON chip on the control circuit board, and computing the frame rate of the first current frame according to the first current pixel clock signal frequency specifically includes:

after the liquid crystal display device being powered on, the main TCON chip and the assist TCON chip obtain an initial table in a storage medium on the control circuit board;

the main TCON chip detecting a pixel clock signal frequency in a video input signal on the control circuit board to obtain the first current pixel clock signal frequency; and the frame rate of the first current frame computed by the main TCON chip being the first current pixel clock signal frequency divided by a total number of the pixels of the liquid crystal display panel.

According to a preferably embodiment of the present disclosure, the step 2 of if the frame rate of the first current frame and the frame rate of the first previous frame have changed, the main TCON chip calls the table corresponding to the frame rate of the first current frame, and the assist TCON chip on the control circuit board also obtains the table specifically includes:

the frame rate of the first current frame computed by the main TCON chip and the frame rate of the first previous frame computed by the main TCON chip being different; and the main TCON chip calling the corresponding table according to the frame rate of the first current frame, and writing the table into the assist TCON chip.

According to a preferably embodiment of the present disclosure, the step 2 of if the frame rate of the first current frame and the frame rate of the first previous frame have changed, the main TCON chip calls the table corresponding to the frame rate of the first current frame, and the assist TCON chip on the control circuit board also obtains the table specifically further includes:

in a range of a preset frame rate, a same liquid crystal driving voltage value is set in a same table.

According to the control method of the time sequential control method mentioned above, the present disclosure further provides a driving circuit, which includes a liquid crystal display panel, a first driving unit, a second driving unit, and a control circuit board. Furthermore, a main timing controller (TCON) chip, an assist TCON chip, a power supply module, and a storage medium are disposed on the control circuit board, the storage medium stores a plurality of tables, the control circuit board is used for receiving a video input signal, the video input signal includes pixel clock signals; the main TCON chip computes a frame rate of a first current frame of the pixel clock signals and obtains a table corresponding to the frame rate of the first current frame according to the frame rate of the first current frame, and the assist TCON chip obtains the table, the main TCON chip and the assist TCON chip respectively transmit the table to the first driving unit and the second driving unit, and the first driving unit and the second driving unit perform scanning on rows or columns of the pixels of the liquid crystal display panel.

According to a preferably embodiment of the present disclosure, the first driving unit includes a first flexible cable, a first signaling board electrically connected to the first flexible cable, and a first source driving chip electrically connected to the first signaling board, the second driving unit includes a second flexible cable, a second signaling board electrically connected to the second flexible cable, and a second source driving chip electrically connected to the second signaling board, and the first source driving chip and the second source driving chip are used for providing a voltage for flipping liquid crystals in the liquid crystal display panel.

According to a preferably embodiment of the present disclosure, the first driving unit is electrically connected to the main TCON chip, and the second driving unit is electrically connected to the assist TCON chip.

According to a preferably embodiment of the present disclosure, the first source driving chip and the second source driving chip are disposed on a non-display region of the liquid crystal display panel.

According to a preferably embodiment of the present disclosure, a material of the first flexible cable and a material of the second flexible cable are chips on a film or cables.

According to a preferably embodiment of the present disclosure, a low voltage differential signal port or an image oriented data transmitting digital port is disposed on an edge of the control circuit board, the low voltage differential signal port or the image oriented data transmitting digital port is used for receiving the video input signal, and the video input signal includes the pixel clock signals.

According to a preferably embodiment of the present disclosure, the main TCON chip computes the frame rate of the first current frame, and the assist TCON chip computes a frame rate of a second current frame, if the frame rate of the first current frame and a frame rate of a first previous frame change, and the frame rate of the second current frame and a frame rate of a second previous frame change, a difference value between the frame rate of the first current frame and the frame rate of the second current frame is obtained, wherein the difference is less than a preset threshold value, and the main TCON chip and the assist TCON chip call the table corresponding to the frame rate of the first current frame.

According to a preferably embodiment of the present disclosure, the preset threshold value is 5.

According to a preferably embodiment of the present disclosure, in a range of a preset threshold value, a same liquid crystal driving voltage is set in the table.

According to a preferably embodiment of the present disclosure, the main TCON chip and the assist TCON chip simultaneously detect a first current pixel clock signal frequency and a second current pixel clock signal frequency, wherein the first frame rate of the first current frame is the first current pixel clock signal frequency divided by a total number of the pixels of the liquid crystal display panel, and the frame rate of the second current frame is the second current pixel clock signal frequency divided by the total number of the pixels of the liquid crystal display panel.

According to a preferably embodiment of the present disclosure, the main TCON chip is used for calling the corresponding table according to the first current frame rate, and the main TCON chip writes the called table into the assist TCON chip.

According to a preferably embodiment of the present disclosure, the power supply module is used for providing voltages of capacitor substrates on two sides of the storage medium, and the power supply module is further used to supply power for the main TCON chip, the assist TCON chip, the first driving unit, and the second driving unit.

In the present disclosure, the main TCON chip and the assist TCON chip compute corresponding frame rates according to pixel clock signal frequencies, then call the corresponding table, and transmit the table to the first driving unit and the second driving unit respectively. The first driving unit and the second driving unit respectively perform scanning on rows or columns of the pixels of the liquid crystal display panel. Compared to a current liquid crystal display device, the main TCON chip and the assist TCON chip of the embodiments of the present disclosure always call the same table to dynamically regulate pixel scanning voltages or pixel grayscale values, thereby solving the problem of using different tables causing inconsistent display of the panel incurred by detection results of two TCON chip frequencies being different. Meanwhile, the scanning voltage varies with the different signals inputted by a video, which allows complicated dynamic images to be displayed with smooth motions.

DESCRIPTION OF DRAWINGS

To more clearly illustrate embodiments or the technical solutions of the present disclosure, the accompanying figures of the present disclosure required for illustrating embodiments or the technical solutions of the present disclosure will be described in brief. Obviously, the accompanying figures described below are only part of the embodiments of the present disclosure, from which those skilled in the art can derive further without making any inventive efforts.

DETAILED DESCRIPTION OF PREFERRED EMBODIMENTS

Figure 1:
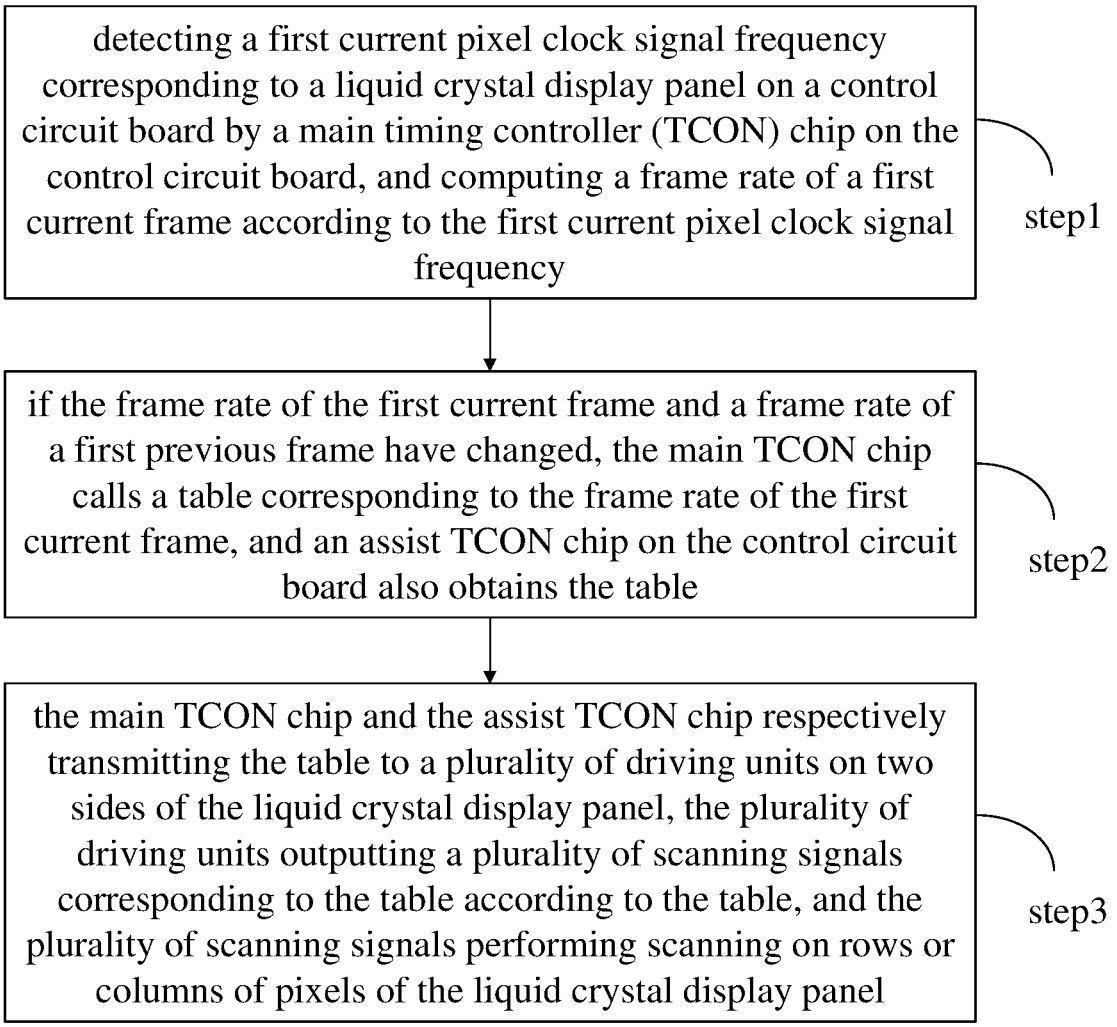
FIG. 1 is a flowchart of a control method of a time sequential control signal provided by an embodiment of the present disclosure.

The descriptions of embodiments below refer to accompanying drawings in order to illustrate certain embodiments which the present disclosure can implement. The directional terms of which the present disclosure mentions, for example, "top", "bottom", "upper", "lower", "front", "rear", "left", "right", "inside", "outside", "side", etc., only refer to directions of the accompanying figures. Therefore, the used directional terms are for illustrating and understanding the present disclosure, but not for limiting the present disclosure. In the figures, units with similar structures are indicated by the same reference numerals.

The present disclosure aims at addressing the technical problem that using two TCON chips liquid crystal display devices in the prior art causes unevenness of image brightness and colors of liquid crystal display panels incurred by change of detected frequencies being different and called tables being different, thereby leading to different flipping voltage values of driving pixels or grayscale values of the pixels being generated. The present disclosure can solve the defect.

As illustrated in FIG. 1, an embodiment of the present disclosure provides a control method of a time sequential control signal. The method includes:

step 1: detecting a first current pixel clock signal frequency corresponding to a liquid crystal display panel on a control circuit board by a main timing controller (TCON) chip on the control circuit board, and computing a frame rate of a first current frame according to the first current pixel clock signal frequency;

step 2: if the frame rate of the first current frame and a frame rate of a first previous frame have changed, the main TCON chip calls a table corresponding to the frame rate of the first current frame, and an assist TCON chip on the control circuit board also obtains the table;

step 3: the main TCON chip and the assist TCON chip respectively transmitting the table to a plurality of driving units on two sides of the liquid crystal display panel, the plurality of driving units outputting a plurality of scanning signals corresponding to the table according to the table, and the plurality of scanning signals performing scanning on rows or columns of pixels of the liquid crystal display panel.

In order to clearly present application points of the present disclosure, the Applicant uses two solutions to illustrate them.

Figure 2:
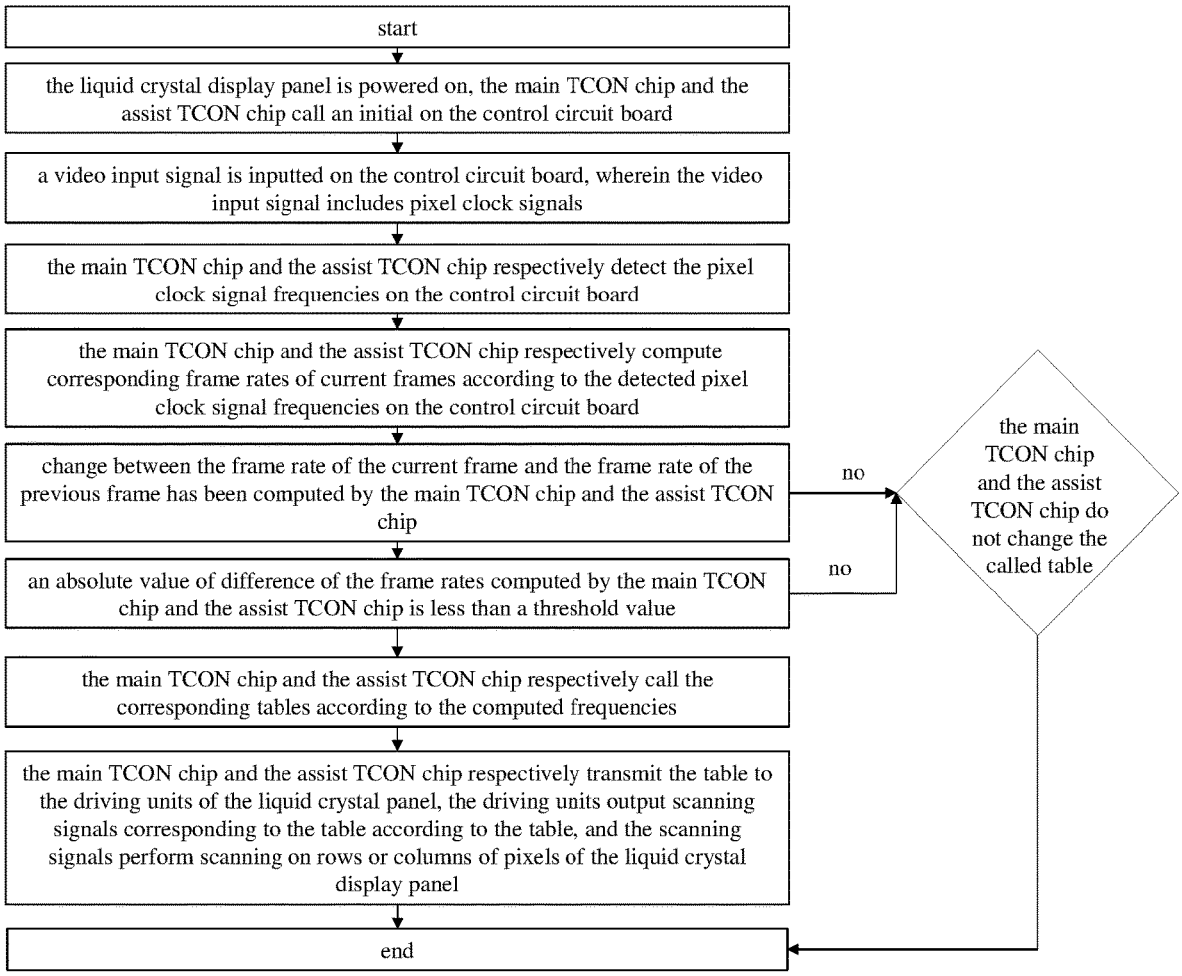
FIG. 2 is a flowchart of the control method of the time sequential control signal provided by an embodiment of the present disclosure.

As illustrated in FIG. 2, the first solution is a flowchart of the control method of the time sequential control signal provided by an embodiment of the present disclosure.

Preferably, the step 1 of detecting the first current pixel clock signal frequency corresponding to the liquid crystal display panel on a control circuit board by the main TCON chip on the control circuit board, and computing the frame rate of the first current frame according to the first current pixel clock signal frequency specifically includes:

after the liquid crystal display panel being powered on, the main TCON chip and the assist TCON chip obtaining an initial table in a storage medium on the control circuit board;

the main TCON chip and the assist TCON chip simultaneously detecting pixel clock signal frequencies in a video input signal on the control circuit board to obtain the first current pixel clock signal frequency and a second current pixel clock signal frequency;

the frame rate of the first current frame computed by the main TCON chip being the first current pixel clock signal frequency divided by a total number of pixels of the liquid crystal display panel; and the frame rate of the second current frame computed by the assist TCON chip being the second current pixel clock signal frequency divided by the total number of pixels of the liquid crystal display panel.

Preferably, the step 2 of if the frame rate of the first current frame and the frame rate of the first previous frame have changed, the main TCON chip calls the table corresponding to the frame rate of the first current frame, and the assist TCON chip on the control circuit board also obtains the table specifically further includes:

the frame rate of the first current frame computed by the main TCON chip and the frame rate of the first previous frame computed by the main TCON chip being different, and the frame rate of the second current frame computed by the assist TCON chip and a frame rate of a second previous frame computed by the assist TCON chip being different; and difference between the frame rate of the first current frame and the frame rate of the second current frame being less than a preset threshold value, and the main TCON chip and the assist TCON chip calling a same table according to the frame rate of the first current frame and the frame rate of the second current frame. Furthermore, the preset threshold value is 5, and in a range of a preset frame rate, a same liquid crystal driving voltage value is set in the table.

Figure 3:
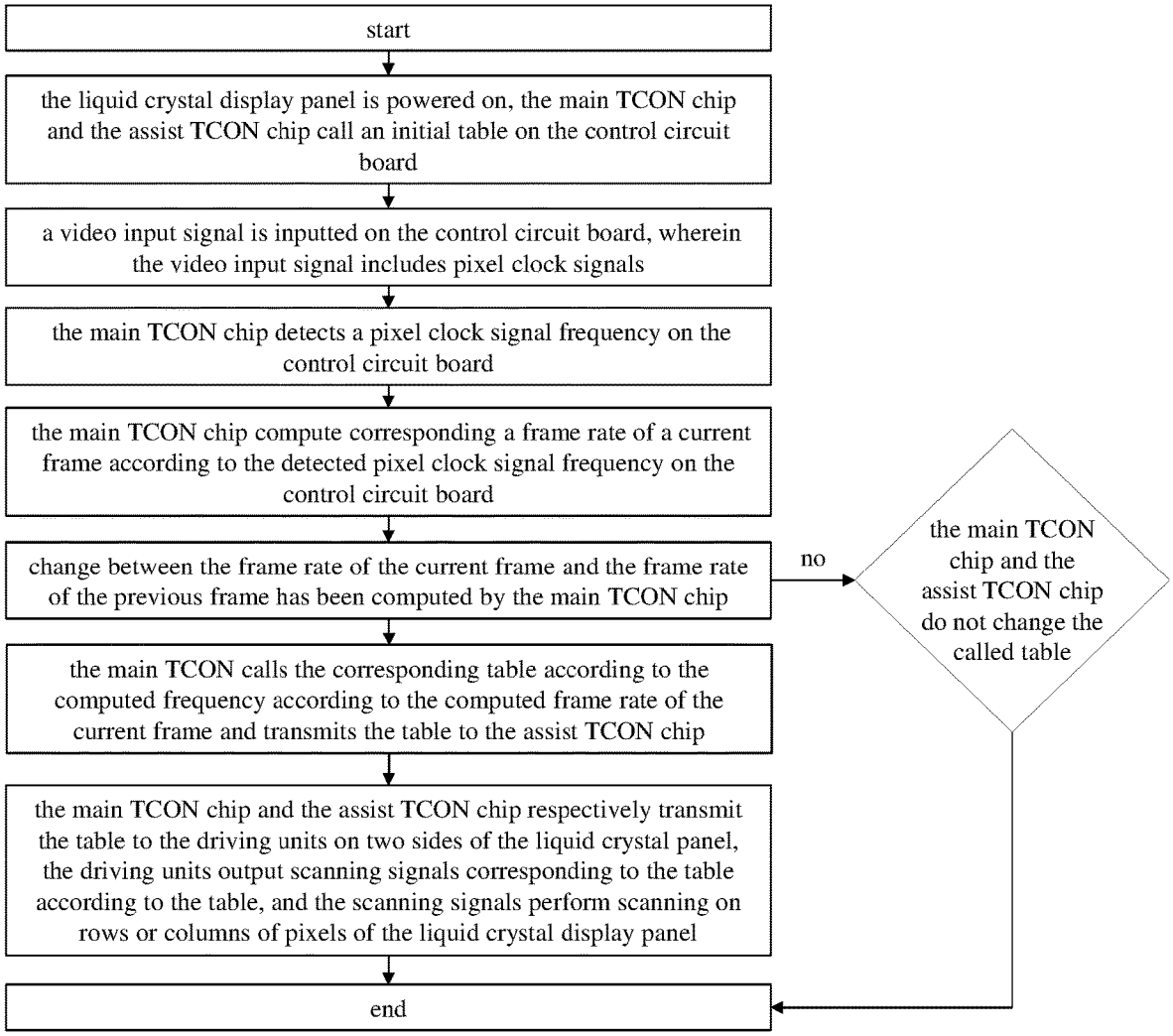
FIG. 3 is another flowchart of the control method of the time sequential control signal provided by an embodiment of the present disclosure.

As illustrated in FIG. 3, the second solution is another flowchart of the control method of the time sequential control signal provided by an embodiment of the present disclosure.

Preferably, the step 1 of detecting the first current pixel clock signal frequency corresponding to the liquid crystal display panel on a control circuit board by the main TCON chip on the control circuit board, and computing the frame rate of the first current frame according to the first current pixel clock signal frequency specifically includes:

after the liquid crystal panel being powered on, the main TCON chip and the assist TCON chip obtaining an initial table in a storage medium on the control circuit board;

the main TCON chip detecting a first current pixel clock signal frequency in a video input signal on the control circuit board to obtain the first current pixel clock signal frequency; and the frame rate of the first current frame computed by the main TCON chip being the first current pixel clock signal frequency divided by a total number of pixels of the liquid crystal display panel.

Preferably, the step 2 of if the frame rate of the first current frame and the frame rate of the first previous frame have changed, the main TCON chip calls the table corresponding to the frame rate of the first current frame, and the assist TCON chip on the control circuit board also obtains the table specifically includes:

the frame rate of the first current frame computed by the main TCON chip and the frame rate of the first previous frame computed by the main TCON chip being different; and the main TCON chip calling the corresponding table according to the frame rate of the first current frame, and writing the table into the assist TCON chip. Furthermore, in a range of a preset frame rate, a same liquid crystal driving voltage value is set in the table.

Figure 4:
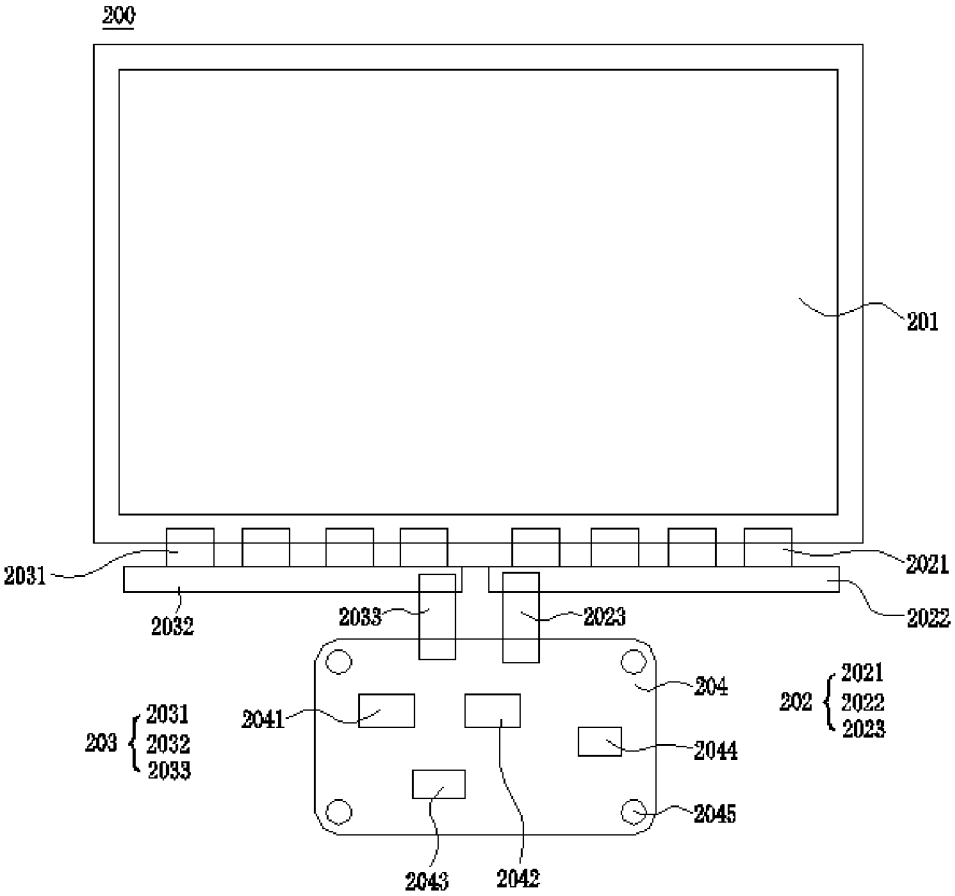
FIG. 4 is a schematic diagram of a driving circuit provided by an embodiment of the present disclosure.

According to the control method of the time sequential control signal, the present disclosure further provides a driving circuit. As illustrated in FIG. 4, the driving unit 200 includes a liquid crystal display panel 201, a first driving unit 202, a second driving unit 203, and a control circuit board 204.

Furthermore, the first driving unit 202 includes a first flexible cable 2023, a first signaling board 2022 electrically connected to the first flexible cable 2023, and a first source driving chip 2021 electrically connected to the first signaling board 2022. The first source driving chip 2021 is used for providing a voltage for flipping liquid crystals in the liquid crystal panel. The first source driving chip 2021 in this embodiment is mainly used for providing the voltage for flipping liquid crystals on a right side of the liquid crystal display panel 201, and the first source driving chip 2021 is preferably disposed on a non-display region on the right side. The second driving unit 203 includes a second flexible cable 2033, a second signaling board 2032 electrically connected to the second flexible cable 2033, and a second source driving chip 2031 electrically connected to the second signaling board 2032. The second source driving chip 2031 is used for providing a voltage for driving the liquid crystals to flip. The second source driving chip 2031 of this embodiment is used for providing the voltage for flipping the liquid crystals on a left side of the liquid crystal display panel 201. The second source driving chip 2031 is preferably disposed on a non-display region on the left side. Materials of the first flexible cable 2023 and the second flexible cable 2033 are preferably chip on films or cables. The main TCON chip 2041, the assist TCON chip 2042, a power supply module 2044, and the storage medium 2043 are disposed on the control circuit board 204. The storage medium 2043 stores a plurality of tables. The power supply module 2044 is used for providing voltages of capacitor substrates on two sides of the storage medium. The power supply module 2044 is further used to supply power for the main TCON chip 2041, the assist TCON chip 2042, the first driving unit 202, and the second driving unit 203.

A low voltage differential signal port or an image oriented data transmitting digital port is disposed on an edge of the control circuit board 204. The low voltage differential signal port or the image oriented data transmitting digital port is used for receiving the video input signal. The video input signal includes the pixel clock signals. The main TCON chip 2041 and the assist TCON chip 2042 compute corresponding frame rates according to the detected clock signal frequencies and call corresponding tables according to the corresponding frame rates. Moreover, the main TCON chip 2041 and the assist TCON chip 2042 always call the same tables and transmit the tables to the first driving unit 202 and the second driving unit 203 respectively. The first driving unit 202 and the second driving unit 203 respectively perform scanning on rows or columns of pixels of the liquid crystal display panel 201. Furthermore, different parameters are set in different tables, and the different parameters correspond to different voltage values in scanning signals in the first driving unit 202 and the second driving unit 203.

After the video signal is inputted to the control circuit board 204, the main TCON chip 2041 detects the first current pixel clock signal frequency. The first frame rate of the first current frame is the first current pixel clock signal frequency divided by a total number of pixels of the liquid crystal display panel. If the frame rate of the first current frame and the frame rate of the first previous frame have changed, the main TCON chip 2041 call the table corresponding to the frame rate of the first current frame, and the main TCON chip 2041 transmit the table to the first driving unit 202 to realize transformation of voltage signals from digital signals, thereby driving display of the pixels on the right side in the liquid crystal display panel 201. Meanwhile, the main TCON chip 2041 writes the corresponding called table into the assist TCON chip 2042. The assist TCON chip 2042 transmits the table to the second driving unit 203 to realize transformation of voltage signals from digital signals, thereby driving display of the pixels on the left side in the liquid crystal display panel 201.

In another specific embodiment, the main TCON chip 2041 and the assist TCON chip 2042 simultaneously detect the first current pixel clock signal frequency and the second current pixel clock signal frequency. The frame rate of the first current frame is the first current pixel clock signal frequency divided by a total number of pixels of the liquid crystal display panel. The frame rate of the second current frame computed by the assist TCON chip is the second current pixel clock signal frequency divided by the total number of pixels of the liquid crystal display panel. If the frame rate of the first current frame and a frame rate of a first previous frame change, and the frame rate of the second current frame and a frame rate of a second previous frame also change, a difference value between the frame rate of the first current frame and the frame rate of the second current frame is obtained, and the difference is less than a preset threshold value. The main TCON chip 2041 and the assist TCON chip 2042 call the table corresponding to the frame rate of the first current frame. The preset threshold value is 5. In a range of a preset frame rate, a same liquid crystal driving voltage is set in the table. The main TCON chip 2041 and the assist TCON chip 2042 call the corresponding table according to the computed frame rate of the first current frame, and then transmit the first driving unit 202 and the second driving unit 203 to realize transformation of voltage signals from digital signals, thereby driving display of the pixels on the left side in the liquid crystal display panel 201.

Beneficial effect of the present disclosure: the embodiments of the present disclosure provides a control method of a time sequential control signal and a driving circuit. In the present disclosure, the main TCON chip and the assist TCON chip compute corresponding frame rates according to pixel clock signal frequencies, then call the corresponding table, and transmit the table to the first driving unit and the second driving unit respectively. The first driving unit and the second driving unit respectively perform scanning on rows or columns of the pixels of the liquid crystal display panel. Compared to a current liquid crystal display device, the main TCON chip and the assist TCON chip of the embodiments of the present disclosure always call the same table to dynamically regulate pixel scanning voltages or pixel grayscale values, thereby solving the problem of using different tables causing inconsistent display of the panel incurred by detection results of two TCON chip frequencies being different. Meanwhile, the scanning voltage varies with the different signals inputted by a video, which allows complicated dynamic images to be displayed with smooth motions.

In summary, although the present disclosure has disclosed the preferred embodiments as above, however the above-mentioned preferred embodiments are not to limit to the present disclosure. A person skilled in the art can make any change and modification, therefore the scope of protection of the present disclosure is subject to the scope defined by the claims.

What is claimed is:

1. A control method of a time sequential control signal, comprising following steps:

detecting a first current pixel clock signal frequency corresponding to a liquid crystal display panel on a control circuit board by a main timing controller (TCON) chip on the control circuit board, and computing a frame rate of a first current frame according to the first current pixel clock signal frequency;

if the frame rate of the first current frame and a frame rate of a first previous frame have changed, the main TCON chip calls a table corresponding to the frame rate of the first current frame, and an assist TCON chip on the control circuit board obtains the table; and the main TCON chip and the assist TCON chip respectively transmitting the table to a plurality of driving units on two sides of the liquid crystal display panel, the plurality of driving units outputting a plurality of scanning signals corresponding to the table according to the table, and the plurality of scanning signals performing scanning on rows or columns of pixels of the liquid crystal display panel, and wherein the step of detecting the first current pixel clock signal frequency corresponding to the liquid crystal display panel on the control circuit board by the main TCON chip on the control circuit board, and computing the frame rate of the first current frame according to the first current pixel clock signal frequency comprises:

after the liquid crystal display panel being powered on, the main TCON chip and the assist TCON chip obtaining an initial table in a storage medium on the control circuit board;

the main TCON chip and the assist TCON chip simultaneously detecting pixel clock signal frequencies in a video input signal on the control circuit board to obtain the first current pixel clock signal frequency and a second current pixel clock signal frequency;

the frame rate of the first current frame computed by the main TCON chip being the first current pixel clock signal frequency divided by a total number of the pixels of the liquid crystal display panel; and a frame rate of a second current frame computed by the assist TCON chip being the second current pixel clock signal frequency divided by the total number of the pixels of the liquid crystal display panel.

2. The control method of the time sequential control signal as claimed in claim 1, wherein the step of if the frame rate of the first current frame and the frame rate of the first previous frame have changed, the main TCON chip calls the table corresponding to the frame rate of the first current frame, and the assist TCON chip on the control circuit board obtains the table comprises:

the frame rate of the first current frame computed by the main TCON chip and the frame rate of the first previous frame computed by the main TCON chip being different, and the frame rate of the second current frame computed by the assist TCON chip and a frame rate of a second previous frame computed by the assist TCON chip being different; and a difference between the frame rate of the first current frame and the frame rate of the second current frame being less than a preset threshold value, and the main TCON chip and the assist TCON chip respectively calling a same table according to the frame rate of the first current frame and the frame rate of the second current frame.

3. The control method of the time sequential control signal as claimed in claim 2, wherein the preset threshold value is 5.

4. A driving circuit, comprising a liquid crystal display panel, a first driving unit, a second driving unit, and a control circuit board;

wherein a main timing controller (TCON) chip, an assist TCON chip, a power supply module, and a storage medium are disposed on the control circuit board, the storage medium stores a plurality of tables, the control circuit board is used for receiving a video input signal, the video input signal comprises pixel clock signals, the main TCON chip is used for computing a frame rate of a first current frame of the pixel clock signals and obtaining a table corresponding to the frame rate of the first current frame according to the frame rate of the first current frame, the assist TCON chip obtains the table, the main TCON chip and the assist TCON chip respectively transmit the table to the first driving unit and the second driving unit, and the first driving unit and the second driving unit perform scanning on rows or columns of pixels of the liquid crystal display panel, and wherein the main TCON chip computes the frame rate of the first current frame, and the assist TCON chip computes a frame rate of a second current frame, if the frame rate of the first current frame and a frame rate of a first previous frame change, and the frame rate of the second current frame and a frame rate of a second previous frame change, a difference value between the frame rate of the first current frame and the frame rate of the second current frame is obtained, wherein the difference is less than a preset threshold value, and the main TCON chip and the assist TCON chip call the table corresponding to the frame rate of the first current frame.

5. The driving circuit as claimed in claim 4, wherein the first driving unit comprises a first flexible cable, a first signaling board electrically connected to the first flexible cable, and a first source driving chip electrically connected to the first signaling board, the second driving unit comprises a second flexible cable, a second signaling board electrically connected to the second flexible cable, and a second source driving chip electrically connected to the second signaling board, and the first source driving chip and the second source driving chip are used for providing a voltage for flipping liquid crystals in the liquid crystal display panel.

6. The driving circuit as claimed in claim 5, wherein the first driving unit is electrically connected to the main TCON chip, and the second driving unit is electrically connected to the assist TCON chip.

7. The driving circuit as claimed in claim 5, wherein the first source driving chip and the second source driving chip are disposed on a non-display region of the liquid crystal display panel.

8. The driving circuit as claimed in claim 5, wherein materials of the first flexible cable and the second flexible cable are chip on film or cables.

9. The driving circuit as claimed in claim 4, wherein a low voltage differential signal port or an image oriented data transmitting digital port is disposed on an edge of the control circuit board, the low voltage differential signal port or the image oriented data transmitting digital port is used for receiving the video input signal, and the video input signal comprises the pixel clock signals.

10. The driving circuit as claimed in claim 4, wherein the preset threshold value is 5.

11. The driving circuit as claimed in claim 10, wherein in a preset threshold value range, a same liquid crystal driving voltage is set in the table.

12. The driving circuit as claimed in claim 4, wherein the main TCON chip and the assist TCON chip simultaneously detect a first current pixel clock signal frequency and a second current pixel clock signal frequency, wherein the first frame rate of the first current frame is the first current pixel clock signal frequency divided by a total number of the pixels of the liquid crystal display panel, and the frame rate of the second current frame is the second current pixel clock signal frequency divided by the total number of the pixels of the liquid crystal display panel.

13. The driving circuit as claimed in claim 4, wherein the main TCON chip is used for calling the corresponding table according to the first current frame rate, and the main TCON chip writes the called table into the assist TCON chip.

14. The driving circuit as claimed in claim 4, wherein the power supply module is used for providing voltages of capacitor substrates on two sides of the storage medium, and the power supply module is used to supply power for the main TCON chip, the assist TCON chip, the first driving unit, and the second driving unit.

15. A control method of a time sequential control signal, comprising following steps:

detecting a first current pixel clock signal frequency corresponding to a liquid crystal display panel on a control circuit board by a main timing controller (TCON) chip on the control circuit board, and computing a frame rate of a first current frame according to the first current pixel clock signal frequency;

if the frame rate of the first current frame and a frame rate of a first previous frame have changed, the main TCON chip calls a table corresponding to the frame rate of the first current frame, and an assist TCON chip on the control circuit board obtains the table; and the main TCON chip and the assist TCON chip respectively transmitting the table to a plurality of driving units on two sides of the liquid crystal display panel, the plurality of driving units outputting a plurality of scanning signals corresponding to the table according to the table, and the plurality of scanning signals performing scanning on rows or columns of pixels of the liquid crystal display panel, and wherein the step of detecting the first current pixel clock signal frequency corresponding to the liquid crystal display panel on the control circuit board by the main TCON chip on the control circuit board, and computing the frame rate of the first current frame according to the first current pixel clock signal frequency comprises:

after the liquid crystal display device being powered on, the main TCON chip and the assist TCON chip obtain an initial table in a storage medium on the control circuit board;

the main TCON chip detecting a pixel clock signal frequency in a video input signal on the control circuit board to obtain the first current pixel clock signal frequency; and the frame rate of the first current frame computed by the main TCON chip being the first current pixel clock signal frequency divided by a total number of the pixels of the liquid crystal display panel.

16. The control method of the time sequential control signal as claimed in claim 15, wherein the step of if the frame rate of the first current frame and the frame rate of the first previous frame have changed, the main TCON chip calls the table corresponding to the frame rate of the first current frame, and the assist TCON chip on the control circuit board obtains the table comprises:

the frame rate of the first current frame computed by the main TCON chip and the frame rate of the first previous frame computed by the main TCON chip being different; and the main TCON chip calling the corresponding table according to the frame rate of the first current frame, and writing the table into the assist TCON chip.

17. The control method of the time sequential control signal as claimed in claim 15, wherein the step of if the frame rate of the first current frame and the frame rate of the first previous frame have changed, the main TCON chip calls the table corresponding to the frame rate of the first current frame, and the assist TCON chip on the control circuit board calls the table comprises:

in a range of a preset frame rate, a same liquid crystal driving voltage is set in the table.

* * * * *